United States Patent [19]

Madison

[11] 4,016,966

[45] Apr. 12, 1977

[54] TYPEWRITER JAM RELEASE MECHANISM

[75] Inventor: Theodore N. Madison, Windsor, Conn.

[73] Assignee: Royal Business Machines, Inc., Hartford, Conn.

[22] Filed: Mar. 24, 1976

[21] Appl. No.: 670,097

Related U.S. Application Data

[60] Continuation of Ser. No. 542,243, Jan. 20, 1975, abandoned, which is a division of Ser. No. 333,389, Feb. 16, 1973, Pat. No. 3,876,054.

[52] U.S. Cl. ..... 197/16; 197/17

[51] Int. Cl.[2] ..... B41J 23/02

[58] Field of Search ..... 192/16, 17, 18, 52, 192/55, 49; 197/81, 12 BA, 36, 26, 41 S

[56] References Cited

UNITED STATES PATENTS

| | | | |
|---|---|---|---|
| 3,004,646 | 10/1961 | Seiden | 192/12 BA X |
| 3,536,172 | 10/1970 | Frechette | 197/16 X |
| 3,581,853 | 6/1971 | Hoff | 192/12 BA X |
| 3,616,887 | 11/1971 | Anderson | 197/17 |
| 3,698,523 | 10/1972 | Bellinger | 192/12 BA |
| 3,720,297 | 3/1973 | Frechette | 197/17 |

*Primary Examiner*—Ralph T. Rader
*Attorney, Agent, or Firm*—Joseph R. Spalla

[57] ABSTRACT

A jam release control for a typewriter provided with a motor driven power train to rotate a power roll. The train includes a normally engaged clutch which can be momentarily disengaged by an operator when the power train is jammed thereby allowing the motor to come up to speed and develop torque as will overcome a jam incident to reengagement of the clutch.

1 Claim, 3 Drawing Figures

12
13
14
15
16
17
18
19
21
22
23
24
25
26
27
33
35
36
37
41
43
44
45
46
47
48
49
51
52
53
54
55
57
58
60
62
63
64
65

TYPEWRITER JAM RELEASE MECHANISM

This is a continuation of application Ser. No. 542,243 filed Jan. 20, 1975, now abandoned, which was a divisional of Ser. No. 333,389, filed Feb. 16, 1973, now U.S. Pat. No. 3,876,054.

This invention relates to electrically powered typewriters, more particularly to an operator controlled jam releasing mechanism and specifically to an operator control mechanism for disengaging a normally engaged clutch between motor and power train incident to a jam to allow the motor to regain speed and clear the jam condition on reengagement of the clutch.

Several arrangements are known to the prior art to break the connection between a motor and power train incident to a jam condition to allow the motor to regain speed and torque sufficient to overcome a jam condition. Such arrangements have been automatic or operator controlled. The present invention is an operator controlled arrangement which is easily implemented and with a minimum of parts.

Other objects, features and advantages of the present invention will become apparent to those skilled in the art from a reading of the following detailed description of a preferred embodiment, taken in conjunction with the accompanying drawing wherein.

DESCRIPTION OF THE INVENTION

Figures 1, 2, 3:
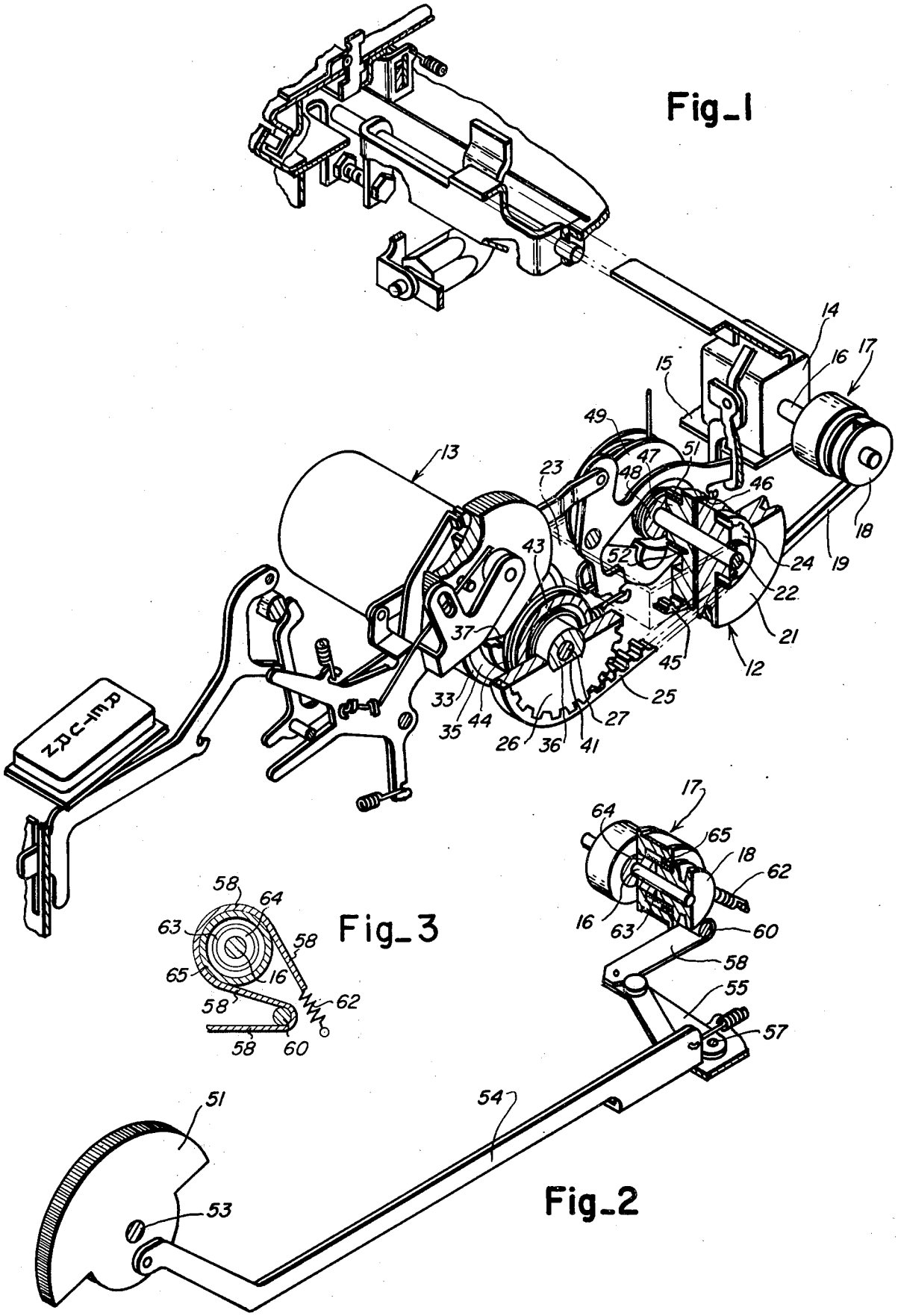
FIG. 1 is a perspective view of a power train and carriage return control mechanism with associated carriage and frame parts.
FIG. 2 is a perspective view showing operator controlled power roll jam release mechanism.
FIG. 3 is a partial cross-section through the clutch between motor and power train, taken along a line perpendicular to the axis of the clutch.

Referring now to the drawing wherein like reference numerals designate like or corresponding parts throughout the several views, there is shown in FIG. 1 a power train in the form of a speed reduction drive generally designated by reference numeral 12, which continuously drives a power roll 13 of a typewriter which, upon engagement by cams of type actions, drives the type actions and machine function mechanisms of the typewriter. The power train includes a motor 14 mounted on a base frame 15 whose output shaft 16 is connected through a normally engaged wrap spring reset clutch assembly generally designated by reference numeral 17 to a motor pulley 18.

The motor pulley 18 is connected by a V-belt 19 to a forwardly located intermediate pulley 21 rotatably mounted on a shaft 22 secured to a side frame supported bracket 23. Pulley 21 is integral with a smaller intermediate toothed pulley 24 on its outboard side which is connected by a toothed belt 25 to a toothed power roll drive pulley 26 rotatably mounted on a power roll support shaft 27 which is adjustably secured to the left and right side frames.

As disclosed in said parent application, the power roll 13 comprises an outer rubber covered sleeve 33 supported on an inner core sleeve. Plastic bearings 35, which are supported on the shaft 27 which extends therethrough, are press fitted into the ends of the core sleeve. The bearing 35 in the right end, as viewed in FIG. 1, has an outwardly extending hub 36 which rotatably supports a toothed carriage return drive pulley 37 which is frictionally driven through a slip clutch (not shown) by the power roll drive pulley 26. The power roll drive pulley 26 is keyed as at 41 to the end of the bearing hub 36 thereby to drive the bearing 35 and the power roll 13. The power roll drive pulley 26 is further provided with a hub 43 extending inwardly around bearing hub 36 which supports an O-ring 44 which serves to drive a carriage return roll cam.

The carriage return drive pulley 37 is connected by a toothed belt 45 to a larger second carriage return drive pulley 46 rotatably mounted on shaft 22 inward of the intermediate drive pulley 21. The carriage return drive pulley 46 is provided with an inward extending hub 47 coaxial with an outward extending hub 48 of a carriage return drawband pulley 49. Wrapped about both hubs 47 and 48 is a normally open clutch wrap spring 51 having one end 52 connected to the carriage return drive pulley 46. The spring constitutes a carriage return clutch. Further details of the carriage return action shown and its operation, not material to the present invention, are disclosed in said parent application.

With reference to FIGS. 2 and 3, a jam reset mechanism is provided to overcome jams causing the motor 14 to stall. Such jams may occur when a number of function keys, such as carriage return, shift, backspace, space bar and tab, are inadvertently depressed when the electrical power supplied to the motor is reduced or when the typewriter is disconnected from a source of electrical power. Accordingly, when power is again supplied to the typewriter, the simultaneous engagement of the various typewriter mechanisms may prevent the motor 14 from operating resulting in a jammed condition.

As viewed in FIGS. 2 and 3, a jam release wheel 51 is rotatably mounted on the machine side frame as at 53 and controls a link 54 eccentrically connected to the wheel 51 at one end and at the other end to and between the ends of a lever 55. The lever 55 is pivoted about a vertical bracket supported pivot 57 at one end and to a friction belt 58 at its other end. The friction belt is trained around a shaft 60 to the rear of and below the reset clutch assembly 17 between motor and drive pulley 18, and around the output of the reset clutch assembly with its other end connected to a spring 62 anchored on the machine frame. The clutch, as before noted, comprises a wrap spring 63 which is tight around a hub 64 secured to the motor shaft 16 and has one end secured to the pulley 18 which has an outer sleeve 65 surrounding the wrap spring 63. Tightening the friction belt 58 serves to frictionally rotate sleeve 65 and thus to unwrap the wrap spring 63 sufficiently to break the motor pulley connection as will allow the motor to come up to speed. Release of the wheel 51 will again allow the wrap spring to wrap and couple the motor shaft 16 to pulley 18 and deliver to the power roll an impact as will aid to release a jam condition.

The invention claimed is:

1. In an electric typewriter having a frame mounting a power roll, a power train for continuously rotating said power roll, and a motor having an output shaft for driving said power train which motor is subject to stalling incident to overload demands on said power roll, and a normally engaged wrap spring clutch between said motor shaft and a pulley in said power train, manually operated means for momentarily disengaging said clutch to allow said motor to resume speed and deliver a power surge to said power roll on reengagement of said clutch, said means including a friction band trained around both a frame-fixed part and a driven part of said clutch, means resiliently connecting one end of said band to said frame, a lever pivoted at one end on said frame, means connecting the other end of said band to the other end of said lever, operator controlled means for moving said lever about its pivot to tension said band on said clutch part to frictionally rotate said clutch part to unwind said wrap spring clutch to allow said motor to resume speed, said operator controlled means including a pivotally mounted segment-shaped member, a link connected to lever and eccentrically mounted on said segment-shaped member, and means for restoring said segment-shaped member after rotation and release thereof by an operator to allow said clutch to reengage.

* * * * *